US006454989B1

(12) United States Patent
Neely et al.

(10) Patent No.: US 6,454,989 B1
(45) Date of Patent: Sep. 24, 2002

(54) PROCESS OF MAKING A CRIMPED MULTICOMPONENT FIBER WEB

(75) Inventors: James Richard Neely; Darryl Franklin Clark, both of Alpharetta; Ty Jackson Stokes, Suwanee, all of GA (US); Chad Michael Freese, Neenah, WI (US); Rebecca Willey Griffin, Woodstock, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/436,669

(22) Filed: Nov. 10, 1999

Related U.S. Application Data

(60) Provisional application No. 60/108,125, filed on Nov. 12, 1998.

(51) Int. Cl.[7] ..... D01D 5/14; D01D 5/24; D01D 5/32; D01D 5/34; D02G 1/00

(52) U.S. Cl. ..... 264/555; 264/103; 264/168; 264/171.28; 264/172.12; 264/172.14; 264/172.15; 264/172.18; 264/210.8; 264/566

(58) Field of Search ..... 264/103, 168, 264/171.28, 172.12, 172.14, 172.15, 172.18, 210.8, 555, 566

(56) References Cited

U.S. PATENT DOCUMENTS

| | | | |
|---|---|---|---|
| 2,931,091 A | | 4/1960 | Breen |
| 3,118,012 A | | 1/1964 | Kilian |
| 3,330,897 A | | 7/1967 | Tessier |
| 3,423,266 A | | 1/1969 | Davis et al. |
| 3,551,271 A | | 12/1970 | Thomas et al. |
| 3,589,956 A | | 6/1971 | Kranz et al. |
| 3,802,817 A | | 4/1974 | Matsuki et al. |
| 3,900,678 A | | 8/1975 | Aishima et al. |
| 4,013,816 A | | 3/1977 | Sabee et al. |
| 4,068,036 A | | 1/1978 | Stanistreet |
| 4,115,620 A | * | 9/1978 | Gupta et al. ..... 264/172.14 X |
| 4,181,762 A | | 1/1980 | Benedyk |
| 4,209,563 A | | 6/1980 | Sisson |

(List continued on next page.)

FOREIGN PATENT DOCUMENTS

| | | |
|---|---|---|
| EP | 0 168 225 A2 | 1/1986 |
| EP | 0 225 926 B1 | 8/1993 |
| EP | 0 277 710 B1 | 4/1994 |
| EP | 0 400 333 B1 | 11/1995 |
| EP | 0 475 307 B1 | 11/1995 |
| EP | 0 685 579 A2 | 12/1995 |
| EP | 0 384 694 B1 | 9/1996 |
| EP | 0 481 092 B1 | 2/1997 |
| EP | 0 757 127 B1 | 2/1997 |
| EP | 0 475 306 B1 | 3/1997 |
| EP | 0 713 546 B1 | 3/1997 |
| EP | 0 625 221 B1 | 5/1997 |
| EP | 0 586 924 B1 | 10/1997 |
| EP | 0 814 189 A1 | 12/1997 |
| EP | 0 696 329 B1 | 3/1998 |
| EP | 0 896 081 A2 | 2/1999 |
| EP | 0 665 315 B1 | 2/2000 |
| GB | 1095147 | 12/1967 |
| GB | 1558592 | 1/1980 |
| JP | 09-294772 A | 11/1997 |
| WO | 97/21862 A2 | 6/1997 |
| WO | 97/49848 A1 | 12/1997 |
| WO | 98/29071 A1 | 7/1998 |
| WO | 98/29482 A1 | 7/1998 |
| WO | 98/29586 A1 | 7/1998 |

*Primary Examiner*—Leo B. Tentoni
(74) *Attorney, Agent, or Firm*—Douglas H. Tulley, Jr.

(57) ABSTRACT

The present invention provides continuously crimped propylene polymer nonwoven fabrics as well as processes for forming crimped multicomponent propylene polymer fibers by melt-attenuating extruded multicomponent fibers with heated or unheated air wherein the fibers spontaneously crimp without the need for additional heating and/or stretching steps.

36 Claims, 4 Drawing Sheets

U.S. PATENT DOCUMENTS 4,269,888 A 5/1981 Ejima et al.
4,361,617 A * 11/1982 Suzuki et al. ..... 442/194
4,405,686 A 9/1983 Kuroda et al.
4,424,258 A 1/1984 Bach
4,429,002 A 1/1984 Fukada et al.
4,461,872 A 7/1984 Su
4,469,540 A 9/1984 Furukawa et al.
4,560,385 A 12/1985 Baravian
4,578,307 A 3/1986 Niki et al.
4,663,220 A 5/1987 Wisneski et al.
4,753,839 A 6/1988 Greenway
4,769,279 A 9/1988 Graham
4,803,117 A 2/1989 Daponte
4,804,577 A 2/1989 Hazelton et al.
4,818,587 A 4/1989 Ejima et al.
4,854,319 A 8/1989 Tobin
4,965,122 A 10/1990 Morman
5,087,720 A 2/1992 Kishita et al.
5,102,724 A 4/1992 Okawahara et al.
5,108,820 A 4/1992 Kaneko et al.
5,188,885 A 2/1993 Timmons et al.
5,208,304 A 5/1993 Waymouth
5,270,107 A 12/1993 Gessner
5,272,236 A 12/1993 Lai et al.
5,278,272 A 1/1994 Lai et al.
5,322,728 A 6/1994 Davey et al.
5,332,624 A 7/1994 Nichols
5,382,400 A 1/1995 Pike et al.
5,393,599 A 2/1995 Quantrille et al.
5,405,682 A 4/1995 Shawver et al.
5,418,045 A 5/1995 Pike et al.
5,427,845 A 6/1995 Sawyer et al.
5,470,639 A 11/1995 Gessner et al.
5,472,775 A 12/1995 Obijeski et al.
5,482,772 A 1/1996 Strack et al.
5,503,907 A 4/1996 Gessner et al.
5,510,183 A 4/1996 Travelute et al.
5,512,358 A 4/1996 Shawyer et al.
5,549,964 A 8/1996 Shohji et al.
5,594,080 A 1/1997 Waymouth et al.
5,614,297 A 3/1997 Velazquez
5,622,772 A 4/1997 Stokes et al.
5,665,300 A 9/1997 Brignola et al.
5,672,415 A 9/1997 Sawyer et al.
5,695,376 A 12/1997 Datta et al.
5,723,546 A 3/1998 Sustic
5,759,926 A 6/1998 Pike et al.
5,804,286 A 9/1998 Quantrille et al.
5,811,045 A 9/1998 Pike
5,858,515 A 1/1999 Stokes et al.
5,876,840 A 3/1999 Ning et al.
5,948,720 A 9/1999 Sun et al.
6,054,002 A * 4/2000 Griesbach, III et al. ..... 264/168 X

* cited by examiner

PROCESS OF MAKING A CRIMPED MULTICOMPONENT FIBER WEB

This application claims priority from U.S. Provisional Application No. 60/108,125 filed on Nov. 12, 1998, the entire contents of which are incorporated herein by reference.

TECHNICAL FIELD

The present invention generally relates to crimped multicomponent nonwoven fabrics and methods of making the same.

BACKGROUND OF THE INVENTION

Nonwoven webs of continuous thermoplastic polymer fibers made by melt-spinning thermoplastic polymers are known in the art. As examples, melt-spun fiber webs or spunbond fiber webs are described in U.S. Pat. No. 4,692,618 to Dorschner et al., U.S. Pat. No. 4,340,563 to Appel et al. and U.S. Pat. No. 3,802,817 to Matsuki et al. In addition, multicomponent spunbond fibers have likewise been made heretofore. The term "multicomponent" refers to fibers formed from at least two polymer streams that have been spun together to form one fiber. Multicomponent fibers comprise fibers having two or more distinct components arranged in substantially constantly positioned distinct zones across the cross-section of the fibers that extend substantially continuously along the length of the fibers. Multicomponent fibers and methods of making the same are known in the art and, by way of example, are generally described in U.S. Pat. No. 5,108,820 to Kaneko et al., U.S. Pat. No. 5,382,400 to Pike et al., U.S. Pat. No. 5,277,976 to Hogle et al., U.S. Pat. No. 5,466,410 to Hills and U.S. Pat. No. 3,423,266 and 3,595,731 both to Davies et al.

The characteristics or physical properties of such nonwoven webs are controlled, at least in part, by the density or openness of the fabric. The web density can be controlled to a great deal by the fiber structure and, in particular, by the curl or crimp of a fiber along its length. Generally speaking, nonwoven webs made from crimped fibers have a lower density, higher-loft and improved resiliency compared to similar spunbond fiber nonwoven webs of uncrimped fibers. Accordingly, various crimped fiber nonwoven webs, and in particular nonwoven webs of crimped multicomponent spunbond fibers, have heretofore been made that have excellent physical characteristics such as good hand, strength and loft.

Various methods of crimping melt-spun fibers are known in the art. For example, it is known in the art to induce fiber crimp with heat such as described in U.S. Pat. No. 4,068,036 to Stanistreet and U.S. Pat. No. 5,382,400 to Pike et al. In addition, PCT Application US97/10717 (publication no. WO 97/49848) discloses a method of forming self-crimping multicomponent spunbond fibers utilizing a polyolefin component and a non-polyurethane elastic block copolymer component such as copolyesters, polyamide polyether block copolymers and A-B or A-B-A block copolymers with a styrenic moiety. These fibers crimp by simply drawing the molten fibers and thereafter releasing the attenuating force; no post-treatment steps are required to induce crimp. In addition, U.S. Pat. No. 5,876,840 to Ning et al. teaches spunbond multicomponent fibers having a non-ionic surfactant additive within one of the components in order to accelerate its solidification rate. By adding the non-ionic surfactant to one of the components of the multicomponent fiber it is possible to develop and activate a latent crimp by drawing with unheated air.

The use of a subsequent heating step to activate latent crimp and produce crimped fibers can be disadvantageous in several respects. Utilization of heat, such as hot air, requires continued heating of a fluid medium and therefore increases capital and overall production costs. In addition, variations in process conditions and equipment associated with high temperature processes can also cause variations in loft, basis weight and overall uniformity. Therefore, there is a continuing need for crimped multicomponent fiber nonwoven fabrics having desirable physical attributes or properties such as softness, resiliency, strength, high porosity and overall uniformity. Further, there exists a continued need for efficient and economical methods for making crimped multicomponent fibers without the need for subsequent heating and/or stretching steps.

SUMMARY OF THE INVENTION

Accordingly, an object of the present invention is to provide improved crimped multicomponent nonwoven fabrics and methods for making the same. Another object of the present invention is to provide nonwoven fabrics with desirable combinations of physical properties such as softness, resiliency, strength, bulk or fullness, density and/or overall fabric uniformity. Another object of the present invention is to provide such nonwoven fabrics having highly crimped filaments and methods for economically making the same.

The aforesaid needs are fulfilled and the problems experienced by those skilled in the art overcome by a method of making a nonwoven web comprising the steps of: (i) extruding continuous multicomponent fibers having a crimpable cross-sectional configuration, said multicomponent fibers comprising a first component and a second component wherein the first component comprises propylene polymer and the second component comprises a different propylene polymer selected from the group consisting of high melt-flow rate polypropylenes, low polydispersity polypropylenes, amorphous polypropylenes, elastomeric polypropylenes and blends and combinations thereof; (ii) quenching the continuous multicomponent fibers; (iii) melt-attenuating the continuous multicomponent fibers wherein the continuous multicomponent fibers spontaneously develop crimp upon release of the attenuating force; and (iv) depositing the continuous multicomponent fibers onto a forming surface to form a nonwoven web of helically crimped fibers. In an additional aspect, the extruded fibers can be pneumatically melt-attenuated without the application of heat.

In a further aspect, fabrics having excellent physical attributes are provided comprising a bonded nonwoven web of crimped multicomponent fibers having a denier less than about 5, said multicomponent fibers comprising a first component and a second component wherein the first component comprises a propylene polymer and the second component comprises a different propylene polymer selected from the group consisting of high melt-flow rate polypropylenes, low polydispersity polypropylenes, amorphous polypropylenes and elastomeric polypropylenes. In a particular aspect, the first component can comprise an inelastic polypropylene and the second component can comprise an elastomeric polypropylene. In a further aspect, the first component can comprise a substantially crystalline polypropylene and the second component can comprise an amorphous polypropylene. In yet a further aspect, the second component can comprise a propylene polymer having a narrow molecular weight distribution with a polydispersity number less than about 2.5 and the propylene polymer of the first component can have a polydispersity number of about 3 or higher. Additionally, the nonwoven fabric can comprise substantially continuously crimped fibers.

DEFINITIONS

Figure 1:
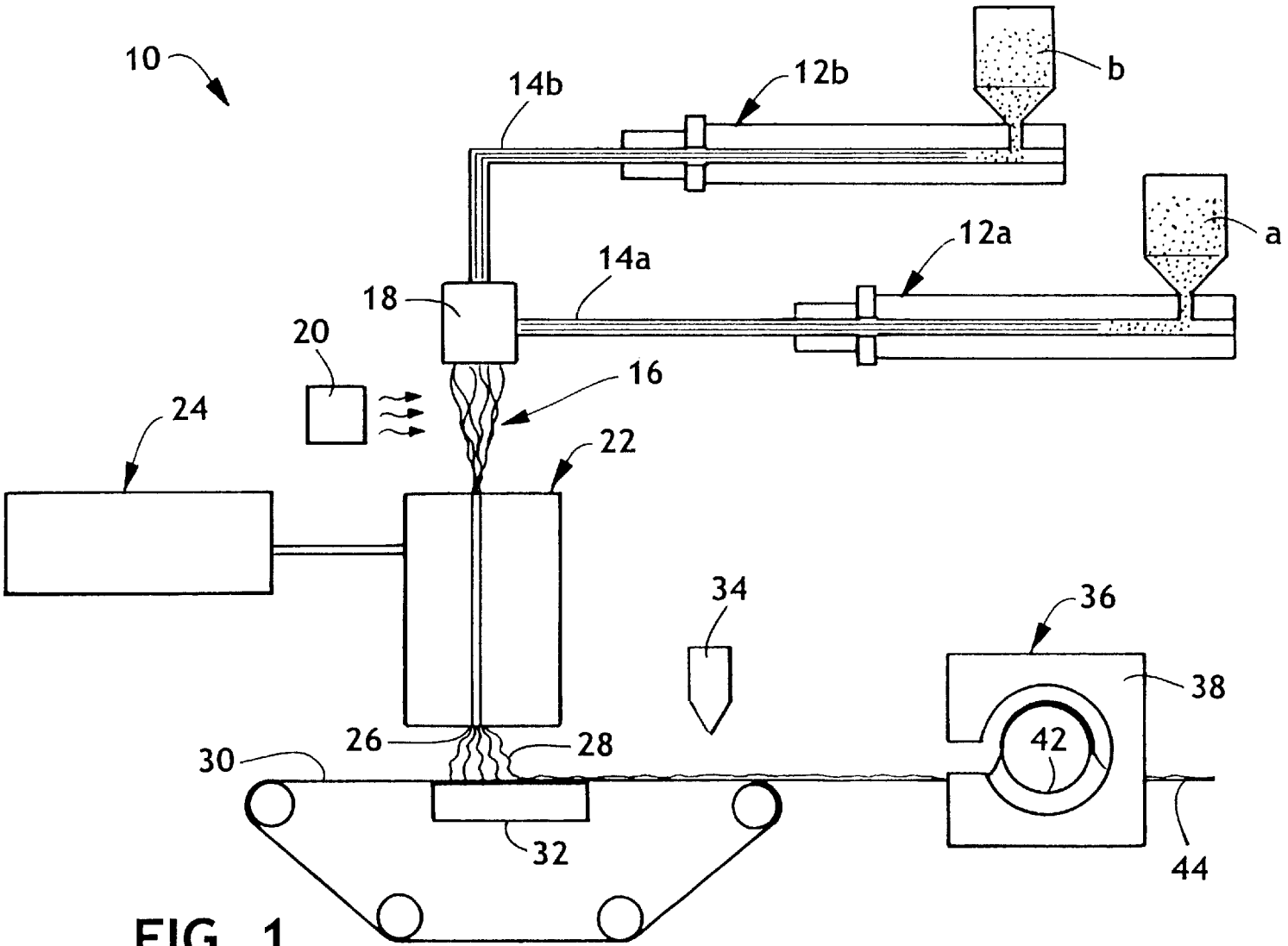
FIG. 1 is a schematic drawing of a process line suitable for practicing the present invention.

As used herein and in the claims, the term "comprising is inclusive or open-ended and does not exclude additional unrecited elements, compositional components, or method steps.

As used herein the term "nonwoven" fabric or web means a web having a structure of individual fibers or threads which are interlaid, but not in an identifiable manner as in a knitted or woven fabric. Nonwoven fabrics or webs have been formed by many processes including, but not limited to, meltblowing processes, spunbonding processes, hydroentangling, air-laid and bonded-carded web processes.

As used herein the term "spunbond fibers" refers to small diameter fibers of melt-attenuated polymeric material. Spunbond fibers are generally formed by extruding molten thermoplastic material as filaments from a plurality of fine capillaries of a spinneret with the diameter of the extruded filaments then being rapidly reduced. Examples of spunbond fibers and methods of making the same are described in U.S. Pat. No. 4,340,563 to Appel et al., U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, U.S. Pat. No. 3,542,615 to Dobo et al, and U.S. Pat. No. 5,382,400 to Pike et al. Spunbond fibers are generally not tacky when they are deposited onto a collecting surface and are substantially continuous in length.

As used herein the term "meltblown fibers" means fibers of polymeric material which are generally formed by extruding a molten thermoplastic material through a plurality of fine, usually circular, die capillaries as molten threads or filaments into converging high velocity air streams which attenuate the filaments of molten thermoplastic material to reduce their diameter. Thereafter, the meltblown fibers can be carried by the high velocity gas stream and are deposited on a collecting surface to form a web of randomly dispersed meltblown fibers. Such a process is disclosed, for example, in U.S. Pat. No. 3,849,241 to Butin et al. and U.S. Pat. No. 5,271,883 to Timmons et al. Meltblown fibers can be formed directly upon a spunbond fiber web to form a cohesive laminate.

As used herein "multilayer laminate" means a laminate of two or more layers such as, for example, a spunbond/meltblown/spunbond (SMS) laminate or a spunbond/film/spunbond (SFS) laminate. Examples of multilayer laminates are disclosed in U.S. Pat. No. 4,041,203 to Brock et al., U.S. Pat. No. 5,178,931 to Perkins et al., U.S. Pat. No. 5,188,885 to Timmons et al. and U.S. Pat. No. 5,695,868 to McCormack. SMS laminates may be made by sequentially depositing onto a moving forming belt first a spunbond fabric layer, then a meltblown fabric layer and last another spunbond layer and then bonding the laminate such as by thermal point bonding as described below. Alternatively, the fabric layers may be made individually, collected in rolls, and combined in a separate bonding step.

As used herein, the term "machine direction" or MD means the direction of the fabric in the direction in which it is produced. The term "cross machine direction" or CD means the direction of the fabric substantially perpendicular to the MD.

As used herein the term "polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" includes all possible spatial configurations of the molecule. These configurations include, but are not limited to isotactic, syndiotactic and random symmetries. Unless otherwise indicated, polymer properties discussed herein are in reference to pre-spinning properties.

As used herein "olefin polymer composition" includes polymer compositions wherein at least 51% by weight of the polymeric composition is a polyolefin polymer.

As used herein "polypropylene" or "propylene polymer" includes propylene-based polymers including propylene homopolymers as well as propylene copolymers or terpolymers wherein at least about 70% of the repeat units comprise propylene.

As used herein "point bonding" means bonding one or more layers of fabric at numerous small, discrete bond points. As an example, thermal point bonding generally involves passing one or more layers to be bonded between heated rolls such as, for example, an engraved or patterned roll and a second roll. The engraved roll is patterned in some way so that the entire fabric is not bonded over its entire surface, and the second roll can either be flat or patterned. As a result, various patterns for engraved rolls have been developed for functional as well as aesthetic reasons. Exemplary bond patterns are described in U.S. Pat. No. 3,855,046 and U.S. Design Pat. No. 375,844 as well as numerous other patents.

As used herein, the term "autogenous bonding" refers to bonding between discrete parts and/or surfaces independently of external additives such as adhesives, solders, mechanical fasteners and the like. As an example, many multicomponent fibers may be autogenously bonded by developing inter-fiber bonds at fiber contact points without significantly degrading either the web or the fiber structure.

As used herein, the term "crimp" means a three-dimensional curl or crimp such as, for example, a helical crimp and does not include random two-dimensional waves or undulations in a fiber.

As used herein the term "blend" means a mixture of two or more polymers while the term "alloy" means a sub-class of blends wherein the components are immiscible but have been compatibilized.

As used herein, the term "garment" means any type of non-medically oriented apparel that may be worm. This includes industrial workwear and coveralls, undergarments, pants, shirts, jackets, gloves, socks, and so forth.

As used herein, the term "infection control product" means medically oriented items such as surgical gowns and drapes, face masks, surgical caps and other head coverings, shoe and boot coverings, wound dressings, bandages, sterilization wraps, wipers, lab coats and aprons, patient bedding and so forth.

As used herein, the term "personal care product" means personal hygiene oriented items such as diapers, training pants, absorbent underpants, adult incontinence products, feminine hygiene products, and so forth As used herein, the term "protective cover" includes, but is not limited to, covers for vehicles (e.g. cars, trucks, boats, etc.), covers for indoor and outdoor equipment, furniture covers, floor coverings, table cloths, tents, tarpaulins and so forth.

DESCRIPTION OF THE INVENTION

Figure 3A:
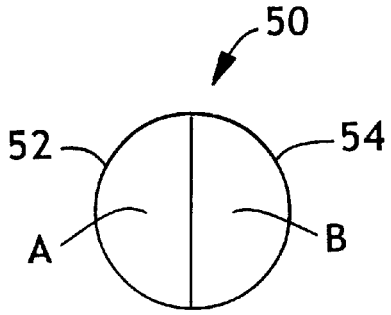
FIG. 3A is a drawing illustrating the cross-section of a multicomponent fiber with the polymer components in a side-by-side arrangement.
Figure 3B:
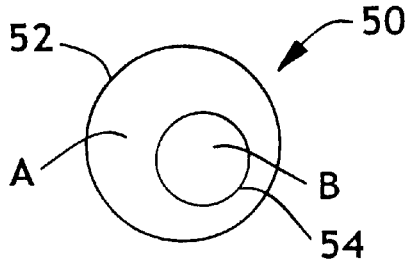
FIG. 3B is a drawing illustrating the cross-section of a multicomponent fiber with the polymer components in an eccentric sheath/core arrangement.
Figure 3C:
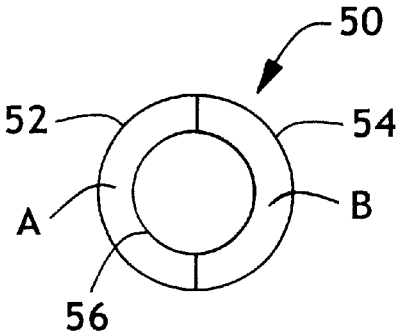
FIG. 3C is a drawing illustrating the cross-section of a multicomponent fiber with the polymer components in a hollow, side-by-side arrangement.
Figure 3D:
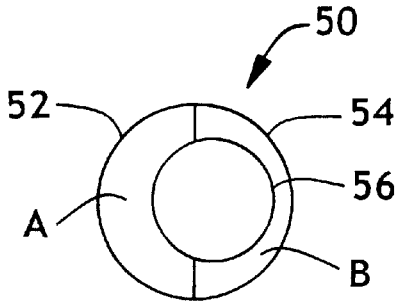
FIG. 3D is a drawing illustrating the cross-section of a multicomponent fiber with the polymer components in an eccentric, hollow side-by-side arrangement.
Figure 3E:
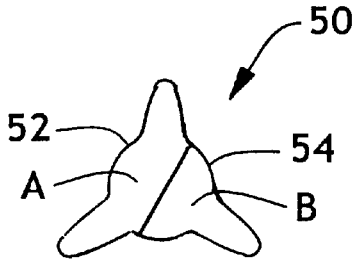
FIG. 3E is a drawing illustrating the cross-section of a multicomponent fiber with the polymer components forming a side-by-side multilobal arrangement.

In practicing the present invention, multicomponent fibers are extruded and attenuated such that the continuous multicomponent fibers spontaneously develop crimp. Thus, the fabric of the present invention includes continuous multicomponent polymeric filaments comprising at least first and second polymeric components. A preferred embodiment of the present invention is a fabric of crimped multicomponent fibers such as, in reference to FIGS. 3A–3E, a continuous bicomponent filament 50 comprising a first polymeric component 52 of a first polymer A and a second polymeric component 54 of a second polymer B. The first and second components 52 and 54 can be arranged in substantially distinct zones within the cross-section of the filament that extend substantially continuously along the length of the filament. The individual components are positioned within the fiber cross-section in a crimpable configuration. As an example, the first and second components 52 and 54 can be arranged in either a side-by-side arrangement as depicted in FIG. 3A or an eccentric sheath/core arrangement as depicted in FIG. 3B. In eccentric sheath/core fibers, one component fully occludes or surrounds the other but is asymmetrically located in the fiber to allow fiber crimp. As additional specific examples, the fibers can comprise hollow fibers as shown in reference to FIGS. 3C and 3D or multilobal fibers as shown in FIG. 3E. However, it is noted that numerous other cross-sectional configurations and/or fiber shapes are suitable for use with the present invention. For crimpable bicomponent fibers, the respective polymer components can be present in ratios (by volume) of from about 85/15 to about 15/85. Ratios of approximately 50/50 are often desirable; however, the particular ratios employed can vary as desired. In this regard, although the particular process described herein is primarily described with respect to bicomponent fibers, the process of the present invention and materials made therefrom are not limited to such bicomponent structures and other multicomponent configurations, for example configurations using more than two polymers and/or more than two components, are intended to be encompassed by the present invention.

In one aspect of the present invention, formation of crimp without the need for applying heat in the draw unit and/or after web formation can be achieved by selecting disparate polymer compositions for the individual components. It will be understood from the teachings herein that the two disparate polymer compositions can comprise similar polymers and even identical polymers such as, for example, where one of the components comprises an additional polymer or a different blend ratio than the other. Forming fiber shapes, in the fiber cross-section, can also be used in combination with the polymer selection to enhance crimp formation. In one aspect, the first polymer component and the second polymer component can be selected so that the resulting multicomponent filaments are capable of developing crimp without additional application of heat either in the draw unit (i.e., during melt attenuation) and/or post-treatments such as after fiber lay down and web formation. The polymeric components comprise polymers that are different from one another in that they have disparate stress or elastic recovery properties, crystallization rates and/or melt viscosities. Such multicomponent fibers can form crimped fibers having a helical crimp in a single continuous direction, that is to say that one polymer will substantially continuously be located on the inside of the helix. Further, in applications where through-air bonding of the webs is desirable, one of the polymer components desirably has a melting point at least about 10° C. lower than that of the other component. Exemplary combinations of polymers include, but are not limited to, those discussed herein below.

As a first example, the multicomponent fibers can comprise a first component comprising a first propylene polymer and a second component comprising a second propylene polymer wherein the second propylene polymer has a narrow molecular weight distribution with a polydispersity number less than that of the first propylene polymer. As an example, the first propylene polymer can comprise a conventional polypropylene and the second propylene polymer can comprise a "single-site" or "metallocene" catalyzed polymer. Conventional polypropylene polymers include substantially crystalline polymers such as, for example, those made by traditional Zeigler-Natta catalysts. Conventional propylene polymers desirably have a polydispersity number greater than about 2.5, a melt-flow rate between about 20–45, and/or a density of about 0.90 or higher. Further, conventional polypropylenes are inelastic polymers. Conventional polypropylenes are widely available and, as one example, are commercially available from Exxon Chemical Company of Houston, Tex. under the trade name ESCORENE. Exemplary polymers having a narrow molecular weight distribution and low polydispersity (relative to conventional propylene polymers) include those catalyzed by "metallocene catalysts", "single-site catalysts", "constrained geometry catalysts" and/or other comparable catalysts. Examples of such catalysts and olefin polymers made therefrom are described in U.S. Pat. No. 5,451,450 to Elderly et al.; U.S. Pat. No. 5,472,775 to Obijeski et al.;

U.S. Pat. No. 5,204,429 to Kaminsky et al.; U.S. Pat. No. 5,539,124 to Etherton et al.; U.S. Pat. Nos. 5,278,272 and 5,272,236, both to Lai et al.; U.S. Pat. No. 5,554,775 to Krishnamurti et al.; and U.S. Pat. No. 5,539,124 to Etherton et al.; the entire contents of the aforesaid references are incorporated herein by reference. Examples of suitable commercially available polymers having narrow molecular weight distribution and low polydispersity are available from Exxon Chemical Company under the trade name ACHIEVE. As a specific example, the multicomponent fibers can comprise a first component of a propylene polymer having a polydispersity number of about 3 or more and a second polymer component comprising a propylene polymer having a polydispersity number less than about 2.5.

In a further aspect, spontaneous crimp can be induced by employing a first polymeric component having significantly lower polymer compliance than the second polymeric component. In this regard the compliance of certain metallocene or single-site catalyzed propylene polymers can be significantly lower than the compliance of conventional propylene polymers. Desirably, the second component comprises a propylene polymer having a compliance at least about 40% less than that of the propylene polymer forming the first component. As a specific example, the second component can comprise a propylene polymer having a compliance of about $0.5\times10^{-5}$ $cm^2$/dyne or less and the first component can comprise a propylene polymer having a compliance of about 133 $10^{-5}$ $cm^2$/dyne or more.

In a further aspect, the crimpable fibers can comprise a first component of a first olefin polymer and a second component of a second olefin polymer wherein the second polymer has a lower density than the first olefin polymer. Still further, the first component can comprise a substantially crystalline polypropylene and the second component can comprise an amorphous polypropylene, that is to say a polypropylene polymer having a lower degree of crystallinity. Desirably the first component has a crystallinity, as measured by the heat of fusion ($\Delta H_f$), at least about 25 J/g greater than that of the second component and, still more desirably, has a crystallinity of at least about 40 J/g greater than that of the second component. As a particular example, the first component can comprise conventional polypropylene and the second component can comprise an amorphous polypropylene, that is to say a polypropylene polymer having a lower degree of crystallinity. In one aspect, the relative degree of crystallinity and/or polymer density can be controlled by the degree branching and/or the relative percent of isotactic, syndiotactic and atactic regions within the polymer. As indicated above, conventional polyolefins generally comprise substantially crystalline polymers and generally have a crystallinity in excess of 70 J/g and desirably, however, have a crystallinity of about 90 J/g or more. The amorphous propylene polymer desirably has a crystallinity of about 65 J/g or less. The degree of crystallinity, or heat of fusion ($\Delta H_f$), can be measured by DSC in accord with ASTM D-3417.

Exemplary propylene based amorphous polymers believed suitable for use with the present invention are described in U.S. Pat. No. 5,948,720 to Sun et al.; U.S. Pat. No. 5,723,546 to Sustic et al.; European Pat. No. 0475307B1 and European patent No. 0475306B1; the entire content of the aforesaid references are incorporated herein by reference. As specific examples, the amorphous ethylene and/or propylene based polymers desirably have densities between about 0.87 g/$cm^3$ and 0.89 g/$cm^3$ with a tensile modulus less than about 50 kpsi (ASTM D-638) and/or an elongation (%) greater than about 900. However, various amorphous polypropylene homopolymers, amorphous propylene/ethylene copolymers, amorphous propylene/butylene copolymers, as well as other amorphous propylene copolymers believed suitable for use in the present invention are known in the art. In this regard, stereoblock polymers are believed well suited for practicing the present invention. The term "stereoblock polymer" refers to polymeric materials with controlled regional tacticity or stereosequencing to achieve desired polymer crystallinity. By controlling the stereoregularity during polymerization, it is possible to achieve atactic-isotactic stereo blocks. Methods of forming polyolefin stereoblock polymers are known in the art and are described in the following articles: G. Coates and R. Waymouth, "Oscillating Stereocontrol: A Strategy for the Synthesis of Thermoplastic Elastomeric Polypropylene" 267 Science 217–219 (January 1995); K Wagener, "Oscillating Catalysts: A New Twist for Plastics" 267 Science 191 (January 1995). Stereoblock polymers and methods of their production are also described in U.S. Pat. No. 5,549,080 to Waymouth et al. and U.S. Pat. No. 5,208,304 to Waymouth. As indicated above, by controlling the crystallinity of alpha-olefins it is possible to provide polymers exhibiting unique tensile modulus and/or elongation properties. Suitable commercially available polymers include, by way of example only, those available from Huntsman Corporation under the trade name REXFLEX FLEXIBLE POLYOLEFINS. These fabrics can also exhibit good extensibility as a result of their high degree of crimp. Further, these particular multicomponent spunbond fibers can exhibit good stretch and recovery characteristics since they can readily return to the original helically crimped structure after extension and upon release of the elongating force.

In a further aspect, the multicomponent fibers can comprise a first component of a first olefin polymer and a second component of a second olefin polymer wherein the first and second olefin polymers have a flexural modulus which differs by at least about 50 kpsi and more desirably differs by at least about 80 kpsi. As a particular example, the first component can comprise a propylene polymer having a flexural modulus of about 170 kpsi or greater, e.g. a conventional propylene polymer, and the second component can comprise an amorphous propylene polymer having a flexural modulus of about 120 kpsi or less. Flexural modulus can be determined in accord with ASTM D-790.

As a further example, the first polymer component can comprise an inelastic olefin polymer and the second olefin polymer component can comprise an olefin elastomer. As an example, the inelastic olefin polymer can comprise conventional polypropylene and the elastic olefin polymer can comprise a REXFLEX FLEXIBLE POLYOLEFIN as described above. Elastic olefin polymers believed suitable for use in the present invention include, but are not limited to, those elastomers discussed herein. Further, additional olefin elastomers believed suitable for use with the present invention include those made by sequential polymerization processes such as those which polymerize polypropylene and ethylene-propylene rubber in multi-stage reactor process. Such olefin elastomers include, but are not limited to, the olefin polymers described in European Pat. No. 400,333B1 and U.S. Pat. No. 5,482,772 to Strack et al. Still further, the first component can comprise a conventional propylene polymer and the second component can comprise a blend of a conventional propylene polymer and a thermoplastic elastomer. Despite having a substantially inelastic component, these fabrics can have good extensibility as a result of the high degree of crimp. Further, these fabrics can also have good recovery characteristics since they readily return to their original helically crimped structure after extension and upon release of the elongating force.

Further examples of polymer combinations believed suitable with the present invention include a propylene polymer component with a polyethylene elastomer component. As examples, ethylene elastomers desirably have a density below 0.89 g/$cm^3$ and, more desirably, have a density between about 0.86 g/$cm^3$ and about 0.87 g/$cm^3$. Polyethylene elastomers can be made by metallocene or constrained geometry catalysts and, as an example, are generally described in U.S. Pat. No. 5,322,728 to Davey et al. and U.S. Pat. No. 5,472,775 to Obijeski et al.; the entire content of each of the aforesaid patents are incorporated herein by reference. As an example, the first component can comprise a conventional propylene polymer and the second component can comprise a polyethylene elastomer. As a further example, a first component can comprise a linear low-density polyethylene (having a density of about 0.92 g/cm$^3$ to about 0.93 g/cm$^3$) and the second component can comprise a polyethylene elastomer. Still further, the first component can comprise an amorphous propylene polymer or stereoblock propylene polymer and the second component can comprise a polyethylene elastomer. Additionally, each of the foregoing examples can be modified by adding a propylene/butylene copolymer to one of the components to further modify the degree of spontaneous crimp.

Further, the crimpable fiber can comprise a first component of a first olefin polymer and a second component comprising an olefin polymer blend. The polyolefin blend can comprise, in part, the same or different olefin polymer as that in the first component. Further, the first polyolefin can optionally comprise a distinct polymer blend. The propylene polymer(s) within the olefin polymer blend desirably comprise a major portion of the blend, i.e. greater than 50% by weight of the blend, and still more desirably comprise between about 65% and about 99.5% by weight of the polymer blend. As an example, the first component can comprise a propylene polymer and the second component can comprise a blend of an identical or similar propylene polymer with a different propylene polymer such as an elastomeric propylene polymer, an amorphous propylene polymer, a high melt-flow rate propylene polymer, a propylene/butylene copolymer and/or an ethylene-propylene copolymer. The second propylene polymer within the second component desirably comprises between about 0.5% and 98%, by weight, of the polymer blend and, still more desirably, comprises between about 5% and about 49%, by weight, of the polymer blend. As a particular example, the second propylene polymer within the second component can comprises between about 5% and about 30%, by weight, of the polymer blend. As an example, the first component can comprise conventional polypropylene and the second component can comprise a major portion of conventional polypropylene and a minor portion of a second propylene polymer such as, for example, a propylene elastomer or an amorphous propylene polymer. Further, the first component can comprise a conventional polypropylene and the second component can comprise a blend of a propylene/ethylene random copolymer and a propylene/butylene random copolymer. Still further, the first component can comprise a conventional polypropylene and the second component can comprise a blend of a conventional polypropylene and a propylene/butylene random copolymer. The above identification of specific olefin polymer blends is not meant to be limiting as additional combinations of polymers and/or blends thereof are believed suitable for use with the present invention.

In a further aspect, a first component can comprise a low melt-flow rate (MFR) olefin polymer and a second component can comprise a high melt-flow rate propylene polymer. In this regard, by increasing the MFR of one component relative to the MFR of the other polymer it is possible to induce spontaneous crimp without the need for additional heating and/or stretching steps. As an example, a bicomponent fiber comprising a linear low density polyethylene component and a conventional homopolymer polypropylene (having an MFR of about 35 g/10 minutes) component does not spontaneously crimp when melt-attenuated with unheated draw air. However, a bicomponent fiber having a linear low-density *polyethylene component and a second polymeric component comprising a propylene polymer having an MFR in excess of about 50 g/10 minute spontaneously develops crimp without the application of heat during melt-attenuation steps. High melt-flow rate polymers and methods of making the same are known in the art. As an example, high melt-flow rate polymers are described in commonly assigned U.S. Pat. No. 5,681,646 to Ofosu et al. and U.S. Pat. No. 5,213,881 to Timmons et al., the entire contents of the aforesaid references are incorporated herein by reference. Melt-flow rate (MFR) can be determined before the polymer is melt-processed in accord with ASTM D1238-95; the specific test conditions (i.e. temperature) will vary with the particular polymer as described in the aforesaid test. As examples, test conditions are 230/2.16 for polypropylene and 190/2.16 for polyethylene.

In addition, as indicated herein above, multicomponent fibers of varied shape and/or cross-sectional configurations can be used in connection with the present invention in order to enhance crimp. As used herein the term "shape or "shaped" refers to fibers other than traditional round, solid fibers and as examples can include hollow fibers, multilobal, ribbon or generally flat shaped fibers, c-shaped or crescent shaped fibers, as well as other geometric or non-geometric shaped fibers. As specific examples, the fibers may have shapes such as those described in U.S. Pat. No. 5,707,735 to Midkiff et al., U.S. Pat. Nos. 5,277,976 to Hogle et al., U.S. Pat. No. 5,466,410 and 5,162,074 to Hills and 5,069,970 and 5,057,368 to Largman et al. Additionally, hollow fibers enhance fiber crimp and can be employed to produce highly crimped fibers using cold draw air and polymer combinations which, if in other fiber configurations, would not otherwise produce high levels of crimp. In reference to FIG. 3C, hollow side-by-side filament 50 comprises a first component 52 of polymer A and a second component 54 of polymer B positioned about a hollow core 56. Further, highly crimpable fibers can be readily formed from eccentric, hollow multicomponent fibers. As an example and in reference to FIG. 3D, a bicomponent fiber 50 can have a first segment 52 of polymer A and a second component of polymer B positioned about an eccentric, hollow core 56.

Figure 4:
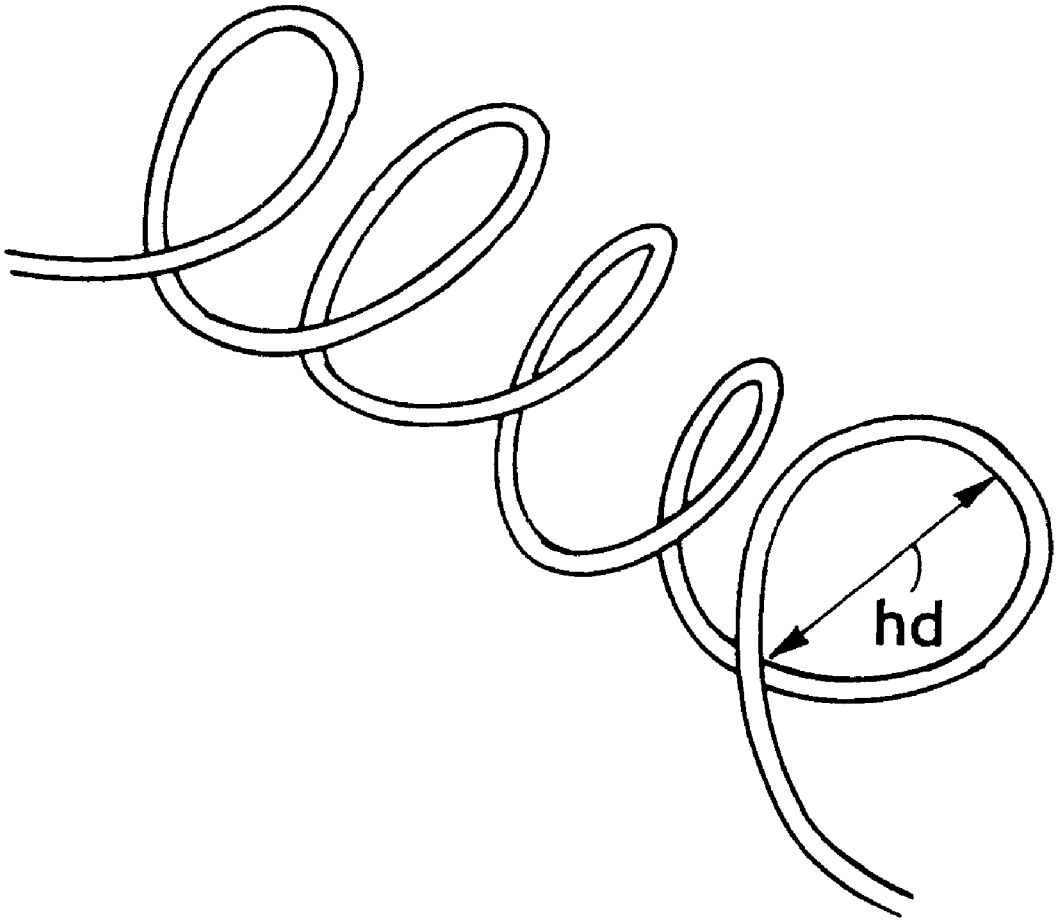
FIG. 4 is a drawing of a helically crimped multicomponent spunbond fiber.

Obtaining good fiber crimp is often considerably more difficult with finer fibers since the increased melt-attenuation necessary to reduce fiber diameter can also act to "pull" out latent crimp. However, it has been found that the method of the present invention can be utilized to create highly crimped fibrous webs using fibers having a denier less than 10 and even fine fibers having a denier less than 2. The crimped multicomponent-spunbond fibers of the present invention desirably have a fiber denier between about 0.5 and about 5. As used herein the term "highly crimped" or 'substantially continuously crimped" means fibrous materials wherein at least about 60% of the fiber length comprises helically crimped sections. Using the process of the present invention, it is possible to achieve fibrous webs of continuous fibers having greater than 75% of the total fiber length comprising helical sections and further wherein greater than about 85% of the fiber length comprises helical sections and still further wherein in excess of about 95% of the fiber length comprises helical sections. Moreover, the present multicomponent spunbond fiber webs can be fabricated into lofty, low-density nonwoven webs of fine denier crimped fibers even at high production rates. In this regard, the loft and/or density of a nonwoven web often reflects the degree of fiber crimp and, within limits, as the degree of crimp increases the density decreases. Thus, the multicomponent fibers can be processed in accord with the present invention so as to provide a continuous fiber web having excellent bulk and porosity. As specific examples, crimped multicomponent spunbond fiber webs for the invention can have a density equal to or less than about 0.09 g/cm$^3$, more desirably between about 0.07 g/cm$^3$ and about 0.005 g/cm$^3$, and still more desirably between about 0.06 g/cm$^3$ and about 0.01 g/cm$^3$. Fabric thickness can be determined in accord with ASTM Standard Test Method D 5729-95 measured under a 0.05 psi load and a 3 inch circular platen. The fabric thickness and basis weight of the fabric are used to calculate the fabric density. In a further aspect, desirably the spontaneously crimped multicomponent fibers have a helical crimp with an average helix diameter less than about 2 mm and still more desirably about 1.5 mm or less. In reference to FIG. 4, helix diameter (hd) is determined by measuring the distance between the vertex and the point at which the fibers intersect.

Figure 2:
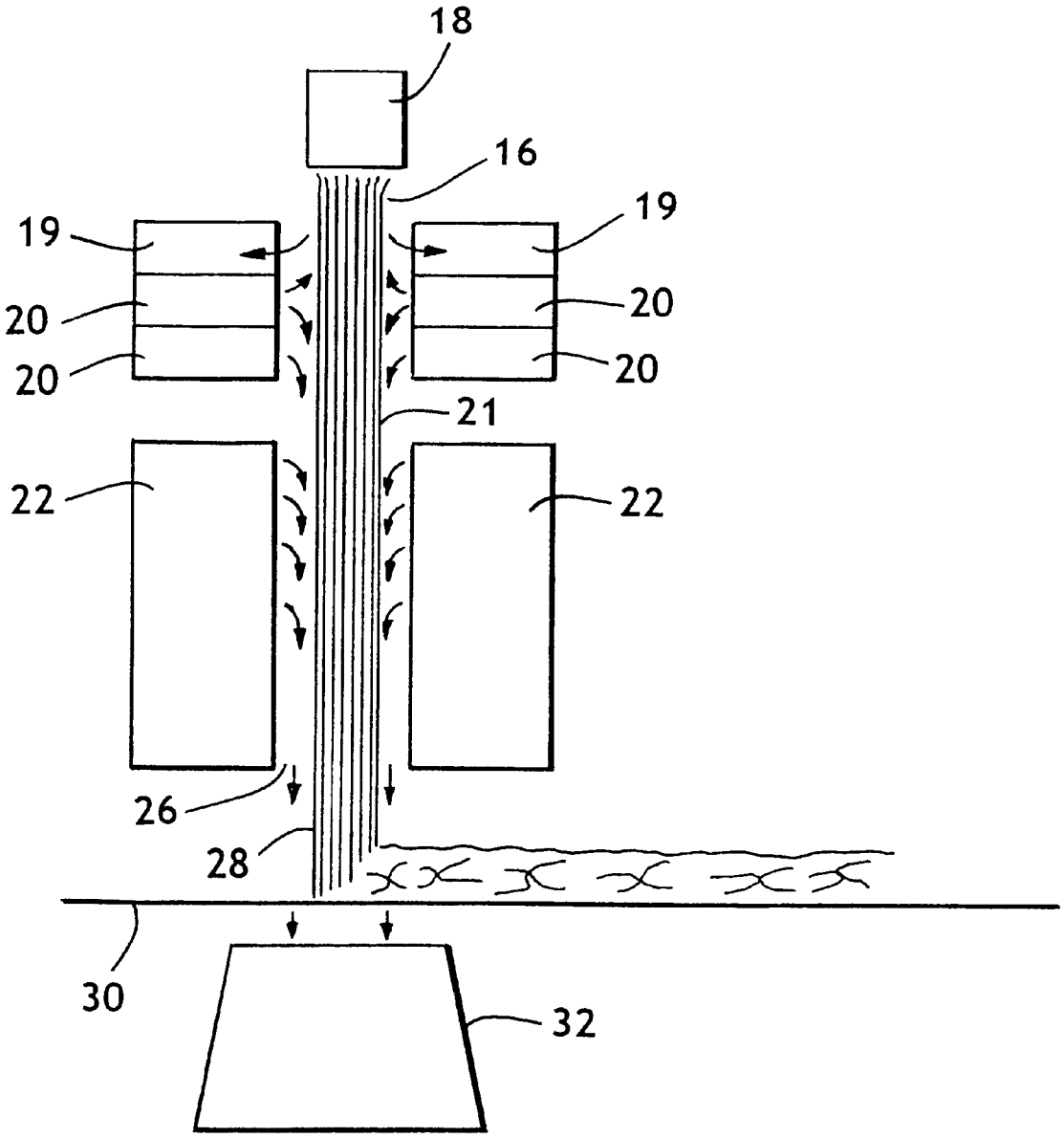
FIG. 2 is a schematic drawing of a pneumatic melt-attenuation system suitable for practicing present invention.

Exemplary methods of making spontaneously-crimped fabrics are more thoroughly described-in reference to FIGS. 1 and 2. In reference to FIG. 1, polymers A and B are fed from extruders 12*a* and 12*b* through respective polymer conduits 14*a* and 14*b* to spin pack assembly 18. Spin packs are known to those of ordinary skill in the art and thus are not described here in detail. Suitable spin pack assemblies and methods of making the same are described in U.S. Pat. No. 5,344,297 to Hills, U.S. patent application Ser. No. 081955,719 to Cook (now U.S. Pat. No. 5,989,004) and PCT Application No. US96/15125 (publication no. WO 97/16585). Generally described, a spin pack assembly can include a housing and a plurality of distribution plates stacked one on top of the other with a pattern of openings arranged to create flow paths for directing polymer components A and B separately through the spin pack assembly. The distribution plates are coupled to a spin plate or spinneret which often has a plurality of openings and which are commonly arranged in one or more rows. A downwardly extending curtain of filaments 16 can be formed when the molten polymers are extruded through the openings of the spinneret. For the purposes of the present invention, spin pack assembly 18 may be arranged to form multicomponent fibers of a desired configuration. The spin pack Is maintained at a sufficiently high temperature to maintain polymers A and B in a molten state at the desired viscosity. As an example, with ethylene and/or propylene polymers the spin pack temperature is desirably maintained at temperatures between about 400° F. (204° C.) and about 500° F. (260° C.).

In reference to FIGS. 1 and 2, the process line 10 can also include one or more quench blowers 20 positioned adjacent the curtain of extruded filaments 16 extending from the spin pack assembly 18. Fumes and air heated from the high temperature of the molten polymer exiting the spin pack assembly, can be collected by vacuum 19 (as shown in FIG. 2) while air from the quench air blower 20 quenches the newly formed filaments 16. The quench air can be directed from only one side of the filament curtain as shown in FIG. 1, or from both sides of the filament curtain or as shown in FIG. 2. As used herein, the term "quench" simply means reducing the temperature of the fibers using a medium that is cooler than the fibers such as, for example, ambient air. In this regard, quenching of the fibers can be an active step or a passive step (e.g. simply allowing ambient air to cool the molten fibers). The fibers are desirably sufficiently quenched to prevent their sticking to the draw unit. In addition, the fibers are desirably substantially uniformly quenched such that significant temperature gradients are not formed within the quenched fibers. Fiber draw unit 22, positioned below both the spin pack assembly 18 and quench blower 20, receives quenched filaments 21. Fiber draw units for use in melt spinning polymers are well known in the art. Suitable fiber draw units for use in the process of the present invention include, by way of example only, a linear fiber aspirator of the type shown in U.S. Pat. No. 3,802,817 to Matsuki et al. and eductive guns of the type shown in U.S. Pat. No. 3,692,618 to Dorschner et al. and U.S. Pat. No. 3,423,266 to Davis et al.; the entire content of each of the aforesaid references are incorporated herein by reference. Additional apparatus for melt-attenuating spontaneously crimpable fibers of the present invention, without additional heat or stretching steps, are also disclosed in U.S. Pat. No. 5,665,300 to Brignola et al.

Generally described, an exemplary fiber draw unit 22 can include an elongate vertical passage through which the filaments are drawn by aspirating air entering from the sides of the passage and flowing downwardly through the passage. The temperature of the aspirating air can be lower than the temperature of the quenched filaments 21. A blower 24 supplies drawing air to the fiber draw unit 22. The cool aspirating air pulls the semi-molten filaments through the column or passage of fiber draw unit 22 and reduces the fiber diameter as well as the temperature of the partially quenched filaments 21. Thus, the filaments are melt-attenuated. In one aspect, the draw air or aspirating air temperature can be less than about 38° C. The draw or aspirating air temperature is desirably between about 15° C. and about 30° C. and still more desirably between about 15° C. and about 25° C. The draw air temperature can be measured from the input air such as, for example, the air temperature within the draw unit manifold. The fiber draw unit desirably provides a draw ratio of at least about 100/1 and more desirably has a draw ratio of about 450/1 to about 1800/1. The draw ratio refers to the ratio of final velocity of the fully drawn or melt-attenuated filament to the velocity of the filament upon exiting the spin pack. Although a preferred draw ratio is provided above, it will be appreciated by those skilled in the art that the particular draw ratio can vary with the selected capillary size and the desired fiber denier.

An endless foraminous forming surface 30 can be positioned below the fiber draw unit 22 to receive the continuous attenuated filaments 28 from the outlet opening 26 of the fiber draw unit 22. A vacuum 32, positioned below the forming surface 30, pulls the attenuated filaments 28 onto the forming surface 30. The deposited fibers or filaments comprise an unbonded, nonwoven web of continuous filaments. The actual formation of crimp is believed to occur as the attenuating force is removed from the filaments and, therefore crimping of the filaments is believed to occur prior to and/or shortly after the continuous filaments are deposited upon the forming surface. In this regard, since the filaments spontaneously crimp a nonwoven web of crimped filaments can be formed without the need for additional heating and/or stretching operations after web formation. The nonwoven web can then, optionally, be lightly bonded or compressed to provide the web with sufficient integrity for additional processing and/or converting operations. As an example, the unbonded web can be lightly bonded using a focused stream of hot air, such as described in U.S. Pat. No. 5,707,468 using a hot-air knife 34 or compaction rollers (not shown). The lightly integrated web can then be bonded as desired such as, for example, by thermal point bonding, ultrasonic bonding, through-air bonding, and so forth.

In reference to FIG. 1, through-air bonder 36 directs a stream of hot air through the lightly integrated web of bicomponent fibers thereby forming inter-fiber bonds. Desirably the through-air bonder 36 utilizes air having a temperature at about or above the melting temperature of the low melting component and below the melting temperature of high melting component. The heated air is directed from the hood 38, through the web, and into the perforated roller 42. The hot air melts the lower melting polymer component and thereby forms durable nonwoven web 44 having autogenous bonds between the bicomponent filaments at fiber contact points. The desired dwell time and air temperature will vary with the particular polymers selected, the desired degree of bonding and other factors known to those skilled in the art. However, through-air bonding will often be more desirable in those particular embodiments where the polymers forming the respective components have melting points at least about 10° C. apart, and even more desirably at least about 20° C. apart. In a further aspect, the web of crimped filaments can be thermally or ultrasonically pattern bonded as is known in the art. For example, an integrated nonwoven web of crimped fibers can be thermal point bonded using a pair of heated bonding rolls, desirably with at least one of the rollers being patterned. Numerous functional and/or aesthetic bond patterns are known in the art. In reference to FIG. 1, the loosely integrated nonwoven web can be fed through the nip formed by heated bonding rolls (not shown), forming an integrated point bonded web of crimped bicomponent fibers. Additionally, as is known in the art, additional thermoplastic films or fabrics can be simultaneously fed into the nip to form a multilayer laminate.

In addition, it will be appreciated by those skilled in the art that various specific process steps and/or parameters could be varied in numerous respects without departing from the spirit and scope of the invention. As one example, the molten fibers may be melt-attenuated utilizing other apparatus known in the art. As an additional example, while the multicomponent fibers of the present invention can be crimped without the use of additional heat, the multicomponent fibers of the present invention can also be crimped in accord with the process described in U.S. Pat. No. 5,382,400 to Pike et al.; the entire contents of which are incorporated herein by reference. As a further example, the spontaneously crimped multicomponent fibers can, optionally, undergo subsequent heating and/or stretching operations after fiber lay-down to further modify the web characteristics as desired.

Crimped fiber nonwoven webs of the present invention have a great variety of uses and include, but are not limited to, articles or components of articles such as garments, infection control products, personal care products, protective fabrics, wipes, filtration materials and so forth. As specific examples, the crimped fiber nonwoven webs can be laminated with one or more films such as, for example, those described in U.S. Pat. No. 5,695,868 to McCormack; U.S. patent application Ser. No. 08/724,435 filed Feb. 10, 1998 to McCormack et al. (now U.S. Pat. No. 6,075,179), U.S. patent application Ser. No. 09/122,326 filed Jul. 24, 1998 to Shawver et al.; U.S. Pat. No. 4,777,073 to Sheth; and U.S. Pat. No. 4,867,881 to Kinzer. Such film/nonwoven laminates are well suited for use as a barrier layer or baffle in personal care articles such as diapers or incontinence garments. In addition, the crimped fabrics of the present invention are well suited for use in hook and loop type fastener applications such as, for example, those described in U.S. Pat. No. 5,707,707 to Bumes et al. and U.S. Pat. No. 5,658,515 to Stokes et al.; the entire contents of each of the aforesaid references are incorporated herein by reference. As further examples, the crimped fiber nonwoven webs can be utilized in various applications, either alone or as part of a multilayer laminate, such as in SMS fabrics described herein above as well as those materials described in U.S. Pat. Nos. 4,965,122 to Monnan et al.; 6,114,781 to Morman et al.; 5,336,545 to Morman et al.; 4,720,415 to Vander Wielen et al.; 5,332,613 to Taylor et al.; 5,540,976 to Shawver et al.; U.S. Pat. No. 3,949,128 to Ostermeier; U.S. Pat. No. 5,620,779 to Levy et al; U.S. Pat. No. 5,714,107 to Levy et al., U.S. Pat. No. 4,041,203 to Brock et al., U.S. Pat. No. 5,188,885 to Timmons et al., U.S. Pat. No. 5,759,926 to Pike et al.; U.S. Pat. No. 5,721,180 to Pike et al.; U.S. Pat. No. 5,817,584 to Singer et al. and U.S. Patent No. 5,879,343 to Dodge et al.

In addition, one or more of the polymeric components of the multicomponent fiber can contain minor amounts of compatibilizing agents, colorants, pigments, optical brighteners, ultraviolet light stabilizers, antistatic agents, wetting agents, abrasion resistance enhancing agents, nucleating agents, fillers and/or other additives and processing aids. Desirably such additives are selected so as not to significantly degrade the spontaneous crimpability of the fibers or other desired attributes of the fibers and corresponding fabric.

EXAMPLES

In each of the examples set forth below, multicomponent continuous spunbond filaments were made using an apparatus as described herein above with regard to FIG. 2. The capillaries had a diameter of 0.6 mm and an L/D ratio of 6:1. The melt temperature was about 445° F. (229° C.). The quench air temperature was 65° F. (18° C.) and the aspirating air, i.e. the draw or melt-attenuating air, temperature was 65° F. (18° C.). The multicomponent fibers formed were bicomponent fibers having a side-by-side configuration with the polymer ratio of the first and second polymer components being 1:1 (i.e. each polymer component comprised about 50%, by volume, of the fiber). Unless indicated otherwise, the fibers had a solid, round cross-section. The continuous spunbond filaments were deposited upon a foraminous surface with the aid of a vacuum and were collected without further processing.

Example 1

The first component comprised conventional propylene polymer (available from Exxon Chemical Co. under the trade name ESCORENE and designation Exxon-3445 which has an MFR of 35, a polydispersity number of 3, a density of 0.9 g/cm$^3$, a flexural modulus of 220,000 psi and yield tensile of 5000 psi) and 2%, by weight, $TiO_2$. The second component comprised a metallocene catalyzed propylene polymer (available from Exxon Chemical Co. under the trade name ACHIEVE and designation Exxon-3854, having a meltflow rate of 25 and a polydispersity number of 2). The resulting spunbond fiber web comprised helically crimped fibers.

Example 2

The first component comprised a conventional propylene polymer as in Example 1 and 2%, by weight, $TiO_2$. The second component comprised an amorphous propylene/ethylene copolymer (available from Huntsman Corporation under the trade name REXFLEX FLEXIBLE POLYOLEFINS and the designation W201 having an MFR of 19, a tensile modulus of 6 and a density of 0.88 g/cm$^3$). The resulting spunbond fiber web comprised helically crimped fibers with good stretch and recovery properties.

Example 3

The first component comprised a conventional propylene polymer as in Example 1 and 2%, by weight, $TiO_2$. The second component comprised an amorphous propylene homopolymer (available from Huntsman Corporation under the trade name REXFLEX FLEXIBLE POLYOLEFINS and the designation W104 having an MFR of 30, a tensile modulus of 14 kpsi and a density of 0.88 g/cm$^3$). The resulting spunbond fiber web comprised helically crimped fibers having good stretch and recovery properties.

Example 4

The first component comprised high melt-flow rate propylene polymer, having an MFR of about 70 (available from Union Carbide Corporation under the designation UCC-WRD5-1254) and 2%, by weight, $TiO_2$. The second component comprised linear low-density ethylene polymer (available from Dow Chemical Company under the trade name ASPUN and designation Dow-6811A). The resulting spunbond fiber web comprised helically crimped fibers.

Example 5

The first component comprised a conventional propylene polymer as described in Example 1 and 2%, by weight, $TiO_2$. The second component comprised a blend of the conventional propylene polymer used in the first component and a propylene/butylene copolymer, comprising about 14% butylene, (available from Union Carbide Corporation under the designation UCC-DS4DO5). The propylene polymer blend of the second component comprised about 70%, by weight, conventional polypropylene and about 30%, by weight, propylene/butylene copolymer. The resulting spunbond fiber web comprised helically crimped fibers.

Example 6

The first component comprised a conventional propylene polymer as described in Example 1 and 2%, by weight, $TiO_2$. The second component comprised a blend of the same propylene polymer used in the first component and a propylene/butylene copolymer, comprising about 14% butylene, (available from Union Carbide Corporation under the designation UCC-DS4DO5). The propylene polymer blend of the second component comprised about 85%, by weight, conventional polypropylene and about 15%, by weight, propylene/butylene copolymer. The resulting spunbond fiber web comprised helically crimped fibers having an average helix diameter of about 0.9 mm.

Example 7

The first component comprised a conventional propylene polymer as described in Example 1 and 2%, by weight, $TiO_2$. The second component comprised a blend of the same propylene polymer used in the first component and an amorphous propylene/ethylene copolymer (available from Huntsman Corporation under the trade name REXFLEX FLEXIBLE POLYOLEFINS and the designation W201). The propylene polymer blend of the second component comprised about 70%, by weight, conventional polypropylene and about 30%, by weight, amorphous propylene copolymer. The resulting spunbond fiber web comprised helically crimped fibers.

Example 8

The first component comprised a conventional propylene polymer as described in Example 1 and 2%, by weight, $TiO_2$. The second component comprised a blend of the conventional propylene polymer used in the first component and an amorphous propylene homopolymer (available from Huntsman Corporation under the trade name REXFLEX FLEXIBLE POLYOLEFINS and the designation W104). The propylene polymer blend of the second component comprised about 70%, by weight, conventional polypropylene and about 30%, by weight, amorphous propylene homopolymer. The resulting spunbond fiber web comprised helically crimped fibers.

Example 9

The first component comprised a conventional propylene polymer as described in Example 1 and 2%, by weight, $TiO_2$. The second component comprised a propylene/ethylene random copolymer (available from Union Carbide Corp. under the designation 6D43 which comprises about 3% ethylene). The fibers were extruded into a concentric hollow, side-by-side fiber such as depicted in FIG. 3C. The resulting spunbond fiber web comprised helically crimped fibers.

Comparative Example 10

The first component comprised a conventional propylene polymer as described in Example 1 and 2%, by weight, $TiO_2$. The second component comprised a linear low-density ethylene polymer (available from Dow Chemical Co. under the trade name ASPUN and designation Dow-6811A). The resulting spunbond fiber web comprised substantially uncrimped fibers.

Numerous other patents and/or applications have been referred to in the specification and to the extent there is any conflict or discrepancy between the teachings incorporated by reference and that of the present specification, the present specification shall control. Additionally, while the invention has been described in detail with respect to specific embodiments thereof, and particularly by the examples described herein, it will be apparent to those skilled in the art that various alterations, modifications and/or other changes may be made without departing from the spirit and scope of the present invention. It is therefore intended that all such modifications, alterations and other changes be encompassed by the claims.

We claim as follows:

1. A method of making a nonwoven web comprising:

extruding continuous multicomponent fibers having a crimpable cross-sectional configuration, said multicomponent fibers comprising a first component and a second component wherein said first component comprises propylene polymer and said second component comprises a different propylene polymer selected from the group consisting of high melt-flow rate polypropylenes, low polydispersity polypropylenes, amorphous polypropylenes and elastomeric polypropylenes;

quenching said continuous multicomponent fibers;

melt-attenuating said continuous multicomponent fibers wherein said continuous multicomponent fibers spontaneously develop crimp upon release of the attenuating force; and depositing said continuous multicomponent fibers onto a forming surface to form a nonwoven web of helically crimped fibers.

2. The method of claim 1 wherein said extruded fibers are pneumatically melt-attenuated and further wherein said deposited multicomponent fibers comprise substantially continuously crimped fibers.

3. The method of claim 1 wherein said fibers are melt-attenuated without the application of heat.

4. The method of claim 2 wherein said fibers are melt-attenuated using air having a temperature less than 38° C.

5. The method of claim 4 wherein the continuous multicomponent fibers are formed with a draw ratio of at least 100/1.

6. The method of claim 5 wherein said multicomponent fibers comprise hollow fibers.

7. The method of claim 4 wherein said multicomponent fibers are substantially uniformly quenched with air and drawn with air having a temperature less than 30° C.

8. The method of claim 4 wherein said second component comprises a propylene polymer having a narrow molecular weight distribution with a polydispersity number less than about 2.5 and wherein the polypropylene of said first component has a polydispersity number of about 3 or higher.

9. The method of claim 4 wherein the propylene polymer of said first component has a flexural modulus of about 50 kpsi or more greater than the propylene polymer of said second component.

10. The method of claim 4 wherein the propylene polymer of the first component has a flexural modulus of at least about 170 kpsi and wherein the propylene polymer of the second component has a flexural modulus of about 120 kpsi or less.

11. The method of claim 4 wherein the propylene polymer of said second component comprises a propylene/ethylene copolymer having a minor portion of ethylene.

12. The method of claim 4 wherein said first component comprises a substantially crystalline propylene polymer and wherein said second component comprises an amorphous propylene polymer.

13. The method of claim 12 wherein said amorphous propylene polymer of said second component comprises propylene homopolymer.

14. The method of claim 13 wherein said second component has a heat of fusion of at least 40 J/g less than that of said first component.

15. The method of claim 14 wherein said multicomponent fibers comprise hollow fibers.

16. The method of claim 4 wherein said first component comprises an inelastic propylene polymer and said second component comprises a polypropylene elastomer.

17. The method of claim 4 wherein said second propylene polymer comprises a polymer having a compliance at least about 40% less than that of said first propylene polymer.

18. The method of claim 3 wherein said first component consists essentially of polypropylene and said second component consists essentially of polymer selected from the group consisting of amorphous polypropylenes, low polydispersity polypropylenes, propylene/ethylene copolymers, propylene/butylene copolymers, and polypropylene elastomers.

19. The method of claim 7 wherein said first component consists essentially of a propylene polymer and said second component consists essentially of polymer selected from the group consisting of amorphous polypropylenes, low polydispersity polypropylenes, propylene/ethylene copolymers, propylene/butylene copolymers, and polypropylene elastomers.

20. A method of making a nonwoven web comprising:

extruding a continuous multicomponent fiber in a crimpable cross-sectional configuration, said multicomponent fiber comprising a first component and a second component wherein said first component comprises a first propylene polymer and said second component comprises a blend of said first propylene polymer and a second propylene polymer selected from the group consisting of low polydispersity polypropylenes, amorphous polypropylenes, elastomeric polypropylenes and propylene copolymers;

quenching said continuous multicomponent fibers;

melt-attenuating said continuous multicomponent fibers wherein said continuous multicomponent fibers spontaneously develop crimp upon release of the attenuating force; and depositing said continuous multicomponent fibers onto a forming surface to form a nonwoven web of helically crimped fibers.

21. The method of claim 20 wherein said extruded fibers are pneumatically meltattenuated and further wherein said deposited multicomponent fibers comprise substantially continuously crimped fibers.

22. The method of claim 21 wherein said fibers are melt-attenuated without the application of heat.

23. The method of claim 22 wherein said multicomponent fibers are substantially uniformly quenched with air and further wherein said crimped fibers have a denier less than about 5.

24. The method of claim 22 wherein said first propylene polymer comprises an inelastic propylene polymer and said second component comprises a blend of an inelastic propylene polymer and a polypropylene elastomer.

25. The method of claim 22 wherein said second propylene polymer comprises a polymer having a compliance at least about 50% less than that of said first propylene polymer.

26. The method of claim 22 wherein said first component comprises a substantially crystalline propylene polymer and said second component comprises a blend of a substantially crystalline propylene polymer and an amorphous polypropylene having a heat of fusion less than about 65 J/g.

27. The method of claim 26 wherein said amorphous polypropylene polymer comprises a propylene homopolymer.

28. The method of claim 22 wherein said second component comprises a blend of a substantially crystalline propylene polymer and a propylene/butylene copolymer.

29. The method of claim 22 wherein said first component consists essentially of a first propylene polymer and said second component consists essentially of a blend of said first propylene polymer and a second propylene polymer selected from the group consisting of low polydispersity polypropylenes, amorphous polypropylenes, elastomeric polypropylenes and propylene copolymers.

30. The method of claim 23 wherein said first component consists essentially of a first propylene polymer and said second component consists essentially of a blend of said first propylene polymer and a second propylene polymer selected from the group consisting of low polydispersity polypropylenes, amorphous polypropylenes, elastomeric polypropylenes and propylene copolymers.

31. A method of making a nonwoven web comprising:

extruding a continuous multicomponent fiber in a crimpable cross-sectional configuration, said multicomponent fiber comprising a first component and a second component wherein said first component comprises a polypropylene and said second component comprises a polyethylene elastomer;

quenching said continuous multicomponent fibers;

melt-attenuating said continuous multicomponent fibers without application of heat wherein said continuous multicomponent fibers spontaneously develop crimp upon release of the attenuating force; and depositing said continuous multicomponent fibers onto a forming surface to form a nonwoven web of helically crimped fibers.

32. The method of claim 31 wherein said extruded fibers are pneumatically meltattenuated utilizing unheated air and further wherein said deposited multicomponent fibers comprise substantially continuously crimped fibers.

33. The method of claim 32 wherein said multicomponent fibers are substantially uniformly quenched with air and further wherein said crimped fibers have a denier less than about 5.

34. A method of making a nonwoven web comprising:

extruding a continuous multicomponent fiber in a crimpable cross-sectional configuration, said multicomponent fiber comprising a first component and a second component wherein said first component comprises a polypropylene having a melt-flow rate greater than 50 g/10 minutes and wherein said second component comprises polyethylene;

quenching said continuous multicomponent fibers;

melt-attenuating said continuous multicomponent fibers without application of heat wherein said continuous multicomponent fibers spontaneously develop crimp upon release of the attenuating force; and depositing said continuous multicomponent fibers onto a forming surface to form a nonwoven web of helically crimped fibers.

35. The method of claim 34 wherein said extruded fibers are pneumatically melt-attenuated utilizing unheated air and further wherein said deposited multicomponent fibers comprise substantially continuously crimped fibers.

36. The method of claims 34 wherein said multicomponent fibers are substantially uniformly quenched with air and further wherein said crimped fibers have a denier less than about 5.

* * * * *

UNITED STATES PATENT AND TRADEMARK OFFICE

CERTIFICATE OF CORRECTION

PATENT NO. : 6,454,989 B1 
DATED : September 24, 2002
INVENTOR(S) : Neely et al.

It is certified that error appears in the above-identified patent and that said Letters Patent is hereby corrected as shown below:

Column 13,
Line 59, "U.S. Pat. No. 5,658,515" should read -- U.S. Pat. No. 5,858,515 --;
Lines 65-66, "U.S. Pat. Nos. 4,965,122 to Monnan et al." should read
-- U.S. Pat. Nos. 4,965,122 to Morman et al. --;
Line 66, "6,114,781 to Morman et al." should read -- 5,114,781 to Morman et al. --.

Signed and Sealed this

Twenty-sixth Day of August, 2003

JAMES E. ROGAN
*Director of the United States Patent and Trademark Office*